US006988525B2

(12) United States Patent
Moulton

(10) Patent No.: US 6,988,525 B2
(45) Date of Patent: Jan. 24, 2006

(54) LIGHT SHELF BLIND

(76) Inventor: Paul Moulton, 504 Highland Ter., Williamsport, PA (US) 17701

( * ) Notice: Subject to any disclaimer, the term of this patent is extended or adjusted under 35 U.S.C. 154(b) by 0 days.

(21) Appl. No.: 10/465,445

(22) Filed: Jun. 19, 2003

(65) Prior Publication Data

US 2004/0256062 A1 Dec. 23, 2004

(51) Int. Cl.
*E04F 10/00* (2006.01)

(52) U.S. Cl. ..... 160/52; 160/98; 160/89; 49/63

(58) Field of Classification Search ..... 160/52, 160/55, 56, 98, 95; 52/74; 359/613, 591, 359/598

See application file for complete search history.

(56) References Cited

U.S. PATENT DOCUMENTS

| | | | | |
|---|---|---|---|---|
| 271,146 | A * | 1/1883 | Stearns | 454/213 |
| 897,775 | A * | 9/1908 | Penfound | 160/56 |
| 1,390,527 | A * | 9/1921 | Gray | 160/22 |
| 1,658,907 | A * | 2/1928 | Smith | 160/52 |
| 2,856,840 | A * | 10/1958 | Smith | 454/196 |
| 5,293,305 | A | 3/1994 | Koster | 362/147 |
| 5,980,052 | A | 11/1999 | Thor | 359/877 |
| 6,239,910 | B1 | 5/2001 | Digert | 359/596 |
| 6,480,336 | B2 | 11/2002 | Digert et al. | 359/596 |

OTHER PUBLICATIONS

Construction Specialties, Inc., C/S Suncontrols 2003 catalogue, copyright 2002, printed in U.S.A., 12 pages.
Construction Specialties, Inc., C/S Daylight Management Systems handout, undated, Cranford, N.J., 2 pages.

* cited by examiner

*Primary Examiner*—Blair M. Johnson
(74) *Attorney, Agent, or Firm*—Robert J. Yarbrough

(57) ABSTRACT

The Invention is a window blind with an integral, adjustable light shelf to control the entry of light into a room through a window. The blind may be a roller blind or any other suitable blind and controls entry of light through a lower portion of the window. The light shelf controls entry of light through an upper portion of the window and may be adjusted to reflect incident sunlight onto the ceiling of the room to provide indirect lighting to the room. The light shelf may be adjusted to substantially or partially exclude light from the room.

11 Claims, 18 Drawing Sheets

LIGHT SHELF BLIND

BACKGROUND OF THE INVENTION

1. Field of the Invention

The Invention relates generally to an apparatus for control of light entering a room through a window and more specifically to a window blind with an integral, retractable light shelf. The Invention comprises a blind, which may be a roller blind, with a light shelf integral to the blind such that direct sunlight may be selectably excluded from a room while indirect sunlight may be selectably allowed to enter the room.

2. Description of the Prior Art

Window blinds, and particularly roller blinds, have been in use for many years. Typically, roller blinds are comprised of a flexible fabric housed on a spring-loaded roller and mounted at the top of a window for the purpose of shading internal room space. Such blinds are rolled (opened) and unrolled (closed) in a vertical plane in order to prevent light and/or vision from the outside of a building or between rooms in a building.

Light shelves also are known in the art. A light shelf is an architectural feature comprising an opaque horizontal shelf adjacent to the interior surface of a window. Sunlight entering the window and striking the top of the shelf is reflected upward into the room, illuminating the ceiling and providing indirect lighting for the room. In addition, the light shelf directly shades a portion of the room. The height of the light shelf above the floor and the depth of the light shelf are selected to achieve the desired degree of indirect illumination and the desired degree of shading of the room while preserving the function of the window of allowing visual communication with the outside.

Prior art light shelves are fixed and are not adjustable. Light shelves therefore are not useful to block entry of light into a room from the portion of the window above the light shelf.

Several efforts have been made to address the problem of light control. For example, U.S. Pat. No. 6,480,336 B2 to Digert issued Nov. 12, 2002 reveals a light shelf design in which multiple, narrow light shelves are arrayed in a fixed position along the upper portion of the inside of a window, redirecting incident sunlight toward the ceiling and providing indirect light for the room. Digert does not teach a movable light shelf and does not teach a light shelf integrated with a window blind.

U.S. Pat. No. 5,980,052 to Thor issued Nov. 9, 1999 teaches a mirror arranged on the outside of a window and reflecting sunlight onto the ceiling of the room inside the window. An electronic apparatus detects the position of the reflected sunlight and adjusts the angle of the mirror. Thor does not teach a light shelf and does not teach a light shelf integrated with a window blind.

U.S. Pat. No. 5,293,305 to Koster issued Mar. 8, 1994 teaches parallel, opaque reflective surfaces directing sunlight toward the ceiling of a room. The reflective surfaces also reflect light from an artificial light source toward the ceiling, providing indirect lighting. Koster does not teach a movable light shelf integrated with a window blind.

Other apparatus have been used to control entry of light into a room. For example, a variety of blades or grills may be attached to the interior or exterior of a window to control entry of light into the room. Blades adapted to move, as in the familiar miniblind, are well known to selectably control the amount of direct sunlight entering the room. The prior art does not teach a window shade integrated with a movable light shelf.

SUMMARY OF THE INVENTION

The Invention comprises a movable light shelf combined with a blind, preferably a roller blind. The combination light shelf and roller blind is mounted across the interior surface of a building window. The light shelf is movable and may be placed in an open position or a closed position.

When the light shelf is in the open position, sunlight entering a portion of the window strikes the upper surface of the light shelf and is reflected in a diffuse manner toward the ceiling of the room. The reflected light illuminates a portion of the ceiling, providing indirect light to the room. When the light shelf is in the closed position, the light shelf is rotated to cover a portion of the window, blocking the sun light from that portion of the window.

The light shelf and roller blind are integrated and supported by the same end supports. The light shelf and roller blind combination is generally mounted on the window so that the light shelf and roller blind combination is above the eye level of a user of the room. The light shelf and roller blind combination effectively divides the window into two portions. Light from the upper portion is controlled by the light shelf. Light from the lower portion of the window is controlled by the blind.

The light shelf and roller blind combination allows considerable flexibility. For example, the light shelf can be selectably placed in the open position, allowing diffuse illumination by sunlight, while the roller blind can be selectably unrolled (lowered) to provide shade from direct sunlight and to provide privacy.

DESCRIPTION OF AN EMBODIMENT

Figure 1:
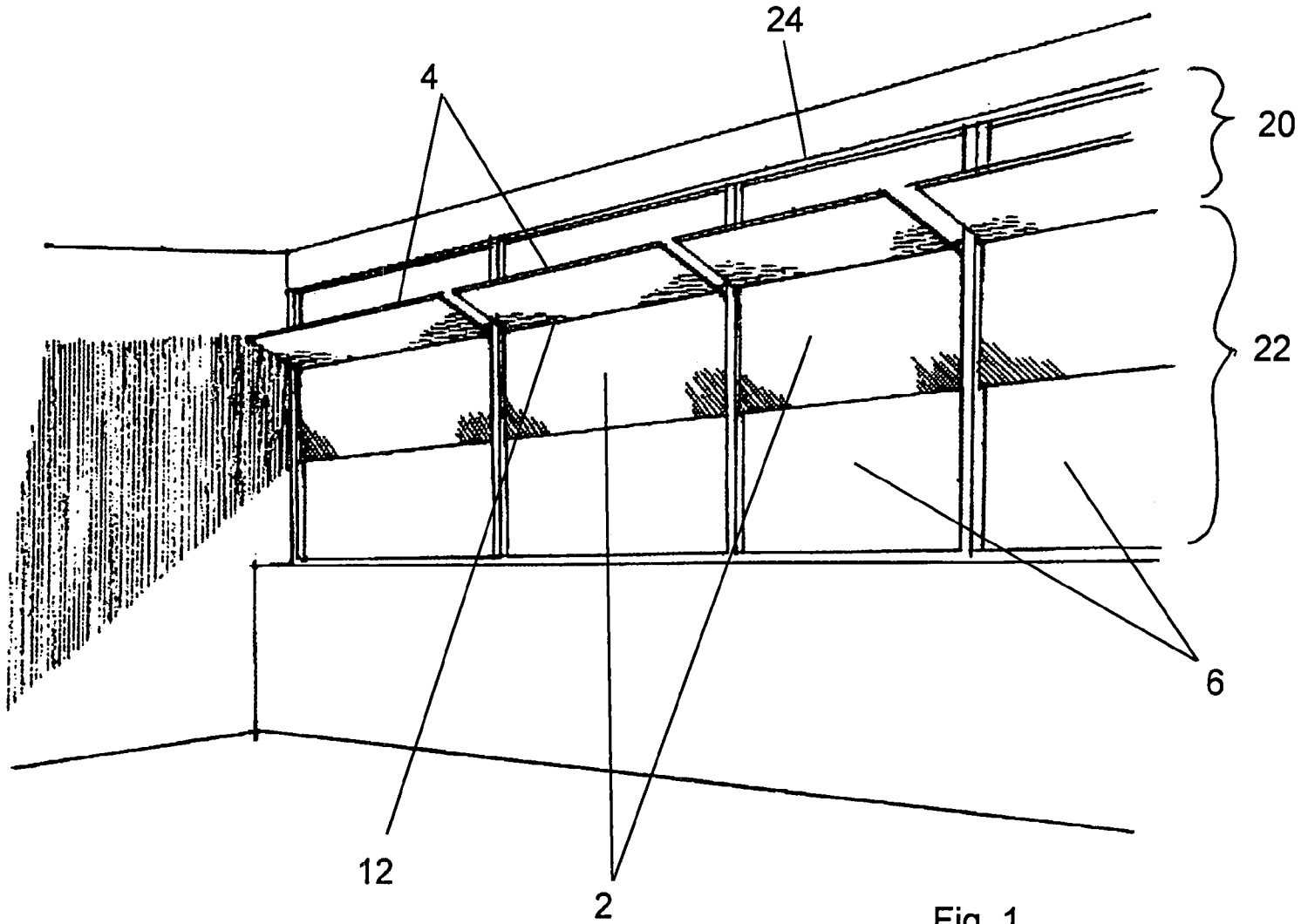
FIG. 1 is a perspective view of light shelf and blind combinations of the Invention installed on windows.
Figure 19:
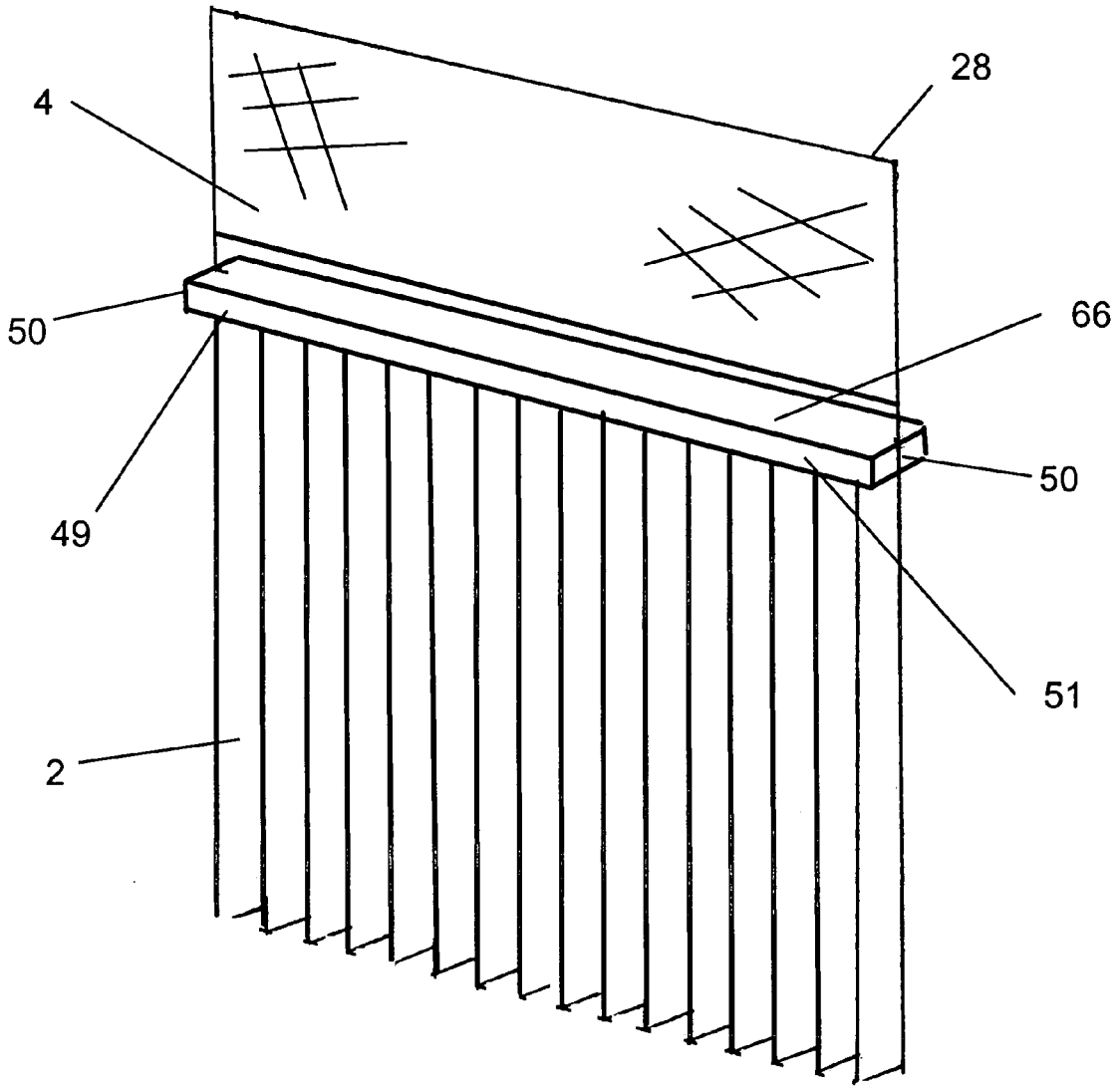
FIG. 19 is an alternative embodiment of the Invention.

FIG. 1 illustrates the combination blind 2 and integral, retractable light shelf 4 of the Invention installed on the interior of a window 6. The light shelf 4 may be integrated with any suitable blind 2. FIGS. 1–9 illustrate the Invention in the context of a roller blind 8. Other suitable blinds 2 include Venetian, vertical and mini-blinds as illustrated by FIG. 19. As used in the claims, the term "roller blind" includes roller blinds 8, Venetian blinds, vertical blinds, mini-blinds and any other movable blind 2 supported on the inside of a window 6.

Figure 2:
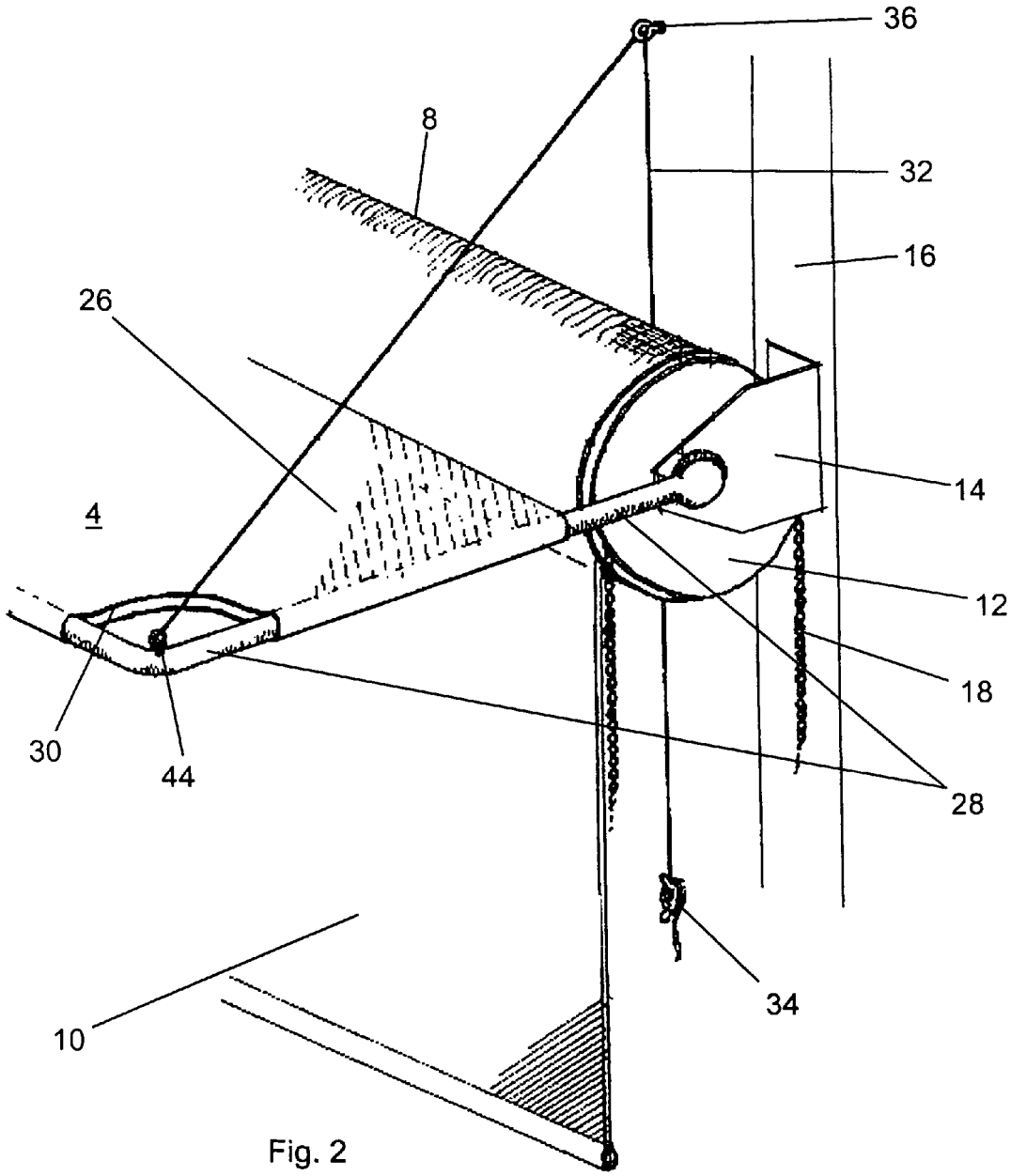
FIG. 2 is a perspective detail view of a portion of the Invention.

As illustrated by FIG. 2, a roller blind 8 comprises a sheet of fabric 10 rolled on a roller 12 and positioned so that a user may selectably unroll the fabric 10 and cover a portion of the window 6. The roller blind fabric 10 may be selected from any suitable material and may be opaque or translucent. The fabric 10 is housed on a roller 12, and the roller 12 is suspended by two end support brackets 14 between the window jambs 16 or from any other suitable architectural element. FIG. 2 illustrates the roller blind 8 manually operated by a chain 18 to roll and unroll fabric 10. Alternatively, the roller blind 8 may be spring loaded, motor driven, operated by a cord, or rolled and unrolled by any other means known to the art of roller blinds 8.

In use, and as illustrated by FIG. 1, the blind 2 and integral, retractable light shelf 4 are mounted to divide a window 6 into two portions: an upper portion 20 above the blind 2 and a lower portion 22 below the blind 2. When the blind 2 is a roller blind 8, the roller blind 8 is configured so that the roller blind 8 may selectably cover the lower portion 22 of the window 6, providing privacy and blocking entry of direct sun light.

As shown by FIGS. 1 and 3–7, the roller 12 of a roller blind 8 is mounted at a position below the head 24 of the window 6 to allow light to pass above the roller 12 into the room. The location of the roller blind 8 below the head 24 of the window 6 is determined by design considerations for a particular installation. In most instances the roller blind 8 and integral light shelf 4 are installed 12 to 36 inches below the head 24 of the window 6.

The retractable light shelf 4 is mounted so that the light shelf 4 may selectably swivel through approximately 90° to at least two positions: an open position and a closed position. In the open position illustrated by FIGS. 1, 2, 4 and 5, the light shelf 4 is generally perpendicular to the window and allows sun light 40 to enter the room through the upper portion 20 of the window 6. The sun light 40 is reflected from the upper surface 26 of the light shelf 4 onto the ceiling of the room, providing indirect lighting to the room. Indirect sun light 40 can thereby enter the room, even when the roller blind 8 is in the closed position. In the closed position illustrated by FIGS. 3, 9 and 19, the light shelf 4 substantially blocks sun light 40 from entering the room from the upper portion 20 of the window 6. The light shelf 4 is mounted in proximity to the roller 12 of the roller blind 8 to reduce penetration of direct sun light 40 between the roller 12 of the roller blind 8 and the light shelf 4.

The light shelf 4 is rotatably mounted to the end support bracket 14 and may be operated separately from the roller blind 8. In a first embodiment illustrated by FIG. 2, the center of rotation of the light shelf 4 corresponds generally to the axis of rotation of the roller 12 of the roller blind 8. In a second embodiment illustrated by FIG. 8, the center of rotation of the light shelf is different from the roller blind axis of rotation.

As shown by FIG. 2, the light shelf 4 is comprised of a frame 28 constructed from a relatively strong, rigid, lightweight material such as steel or aluminum. The frame 28 material may be tubular. A web 30 is supported by the frame 28. The web 30 may comprise any suitable material, such as a synthetic or natural fabric, a paper, foam, a polymer, a sheet of metal or a piece of wood. The web 30 may be flexible or rigid. The web 30 may be a fabric selected to complement the fabric 10 of the roller blind 8 and may be opaque or translucent. The web 30 may be treated to enhance the reflection of light from the upper surface 26 of the web 30. The web 30 may be mounted in a single layer or a double layer on the frame 28.

In the embodiment illustrated by FIG. 2, the position of the light shelf 4 may be adjusted by adjusting the length of a cord 32 extending from a cleat 34 through an eyelet 36 and to the light shelf 4. In the embodiment of FIG. 2, the position of the light shelf 4 is infinitely variable and the range of motion of the light shelf 4 exceeds 90°.

Figure 3:
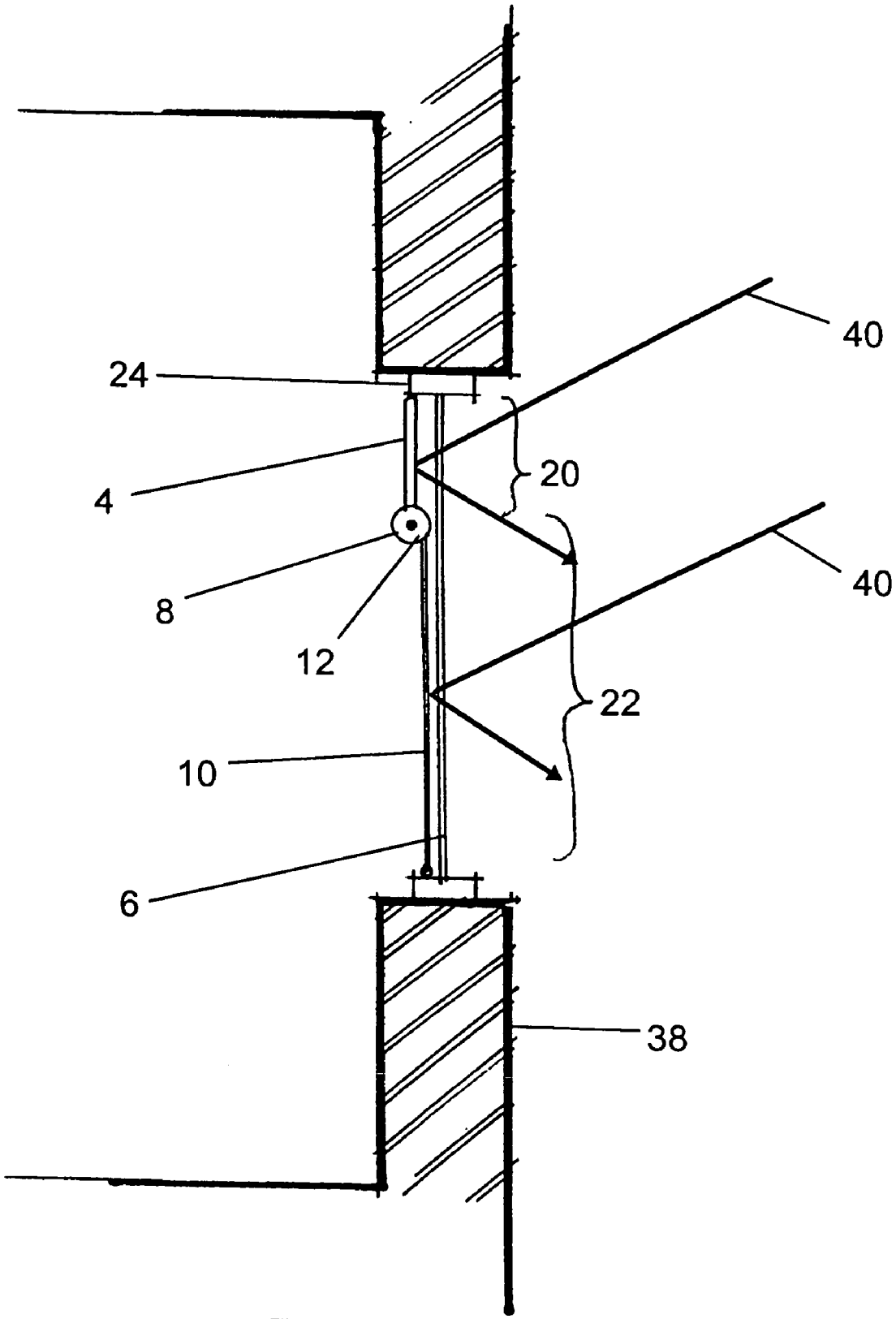
FIG. 3 is an end view of the Invention in operation with the light shelf and blind in the closed positions.

FIG. 3 illustrates a cross section of a wall 38 of a building with the roller blind 8 and integral light shelf 4 installed in a window 6. In FIG. 3, the light shelf 4 is in the closed position. The upper surface 26 of the light shelf 4 defines a plane, and the plane defined by the upper surface 26 of the light shelf 4 is generally parallel to the surface of the upper portion 20 of the window 6. Light 40 passing through the upper portion 20 of the window 6 and reflecting from the upper surface 26 of the light shelf 4 is reflected toward the window 6 and does not enter the room. The level of light in the room is thereby reduced. FIG. 3 also illustrates the roller blind 8 in the closed position. Light 40 passing through the lower portion 22 of the window 6 and reflecting from the roller blind fabric 10 is reflected toward the window 6 and does not enter the room.

The closed position of the roller blind 8 and light shelf 4 illustrated by FIG. 3 correspond to a low light level in the room. In an institutional setting such as a school, the low light level illustrated by FIG. 3 is useful for showing movies, slides, overhead projector images or other demonstrations where a low light level is required. The low light level illustrated by FIG. 3 is not possible with conventional light shelf 4 designs.

Figure 4:
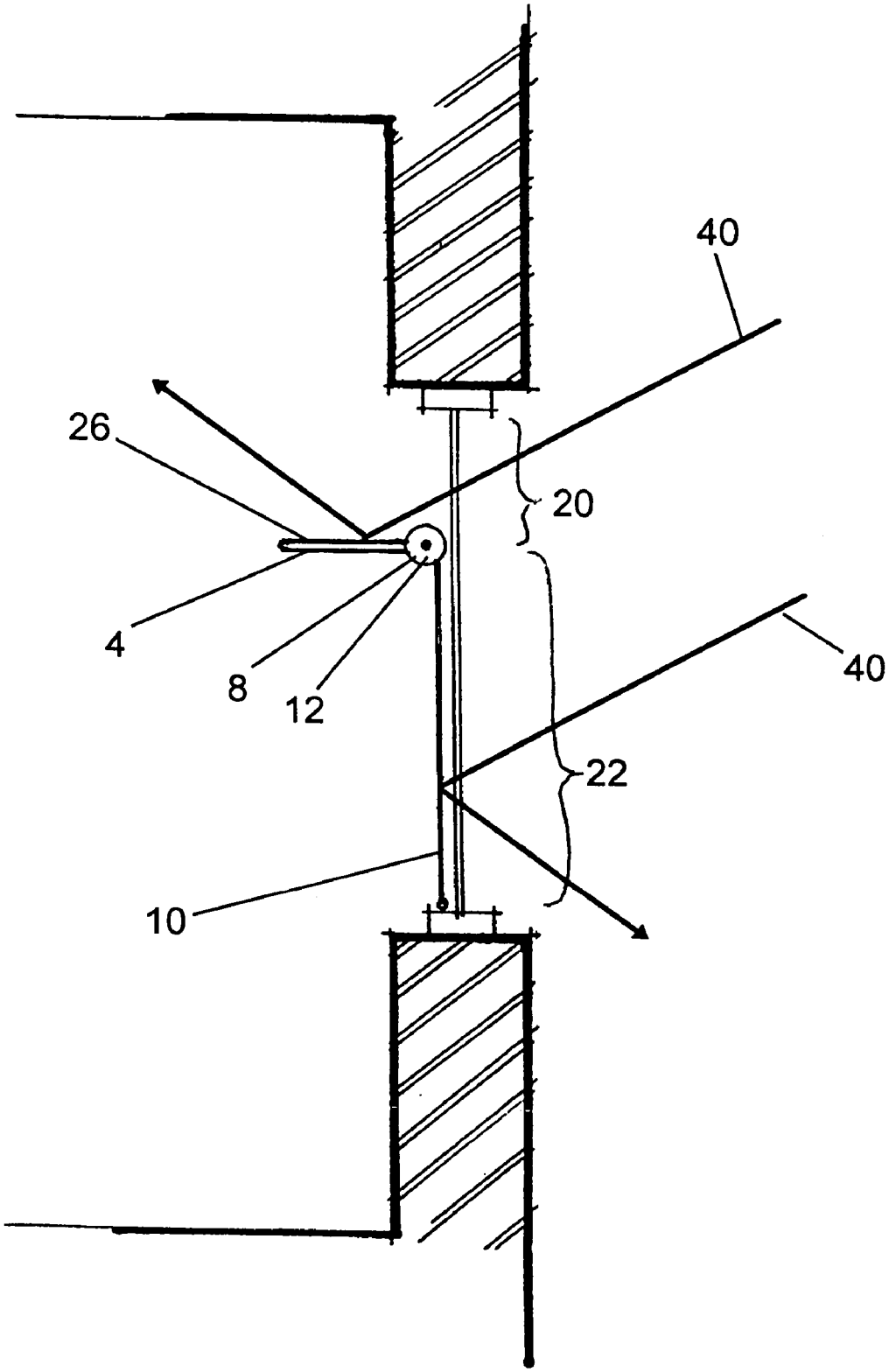
FIG. 4 is an end view of the Invention in operation with the light shelf in an open position and the blind in a closed position.

FIG. 4 illustrates the light shelf 4 in an open position and the roller blind 8 in a closed (unrolled) position. In the open position, the light shelf 4 is placed at a user-selected angle that serves to reflect light 40 generally toward the ceiling of the room. In the configuration illustrated by FIG. 4, the closed roller blind 8 prevents direct light 40 from entering through the lower portion 22 of the window 6 and further preserves privacy while the open light shelf 4 allows indirect sun light 40 to enter the room. For a vertical window 6 and a typical ceiling, the angle of the light shelf 4 in the open position generally will be selected so that the plane defined by the light shelf 4 is perpendicular to the window 6. Any appropriate angle for the light shelf 4 may be selected to direct reflected light 40 in any desired direction. Changing the angle of the light shelf 4 to allow a change in direction of reflected sun light 40 is not possible in conventional light shelf 4 designs.

Figure 5:
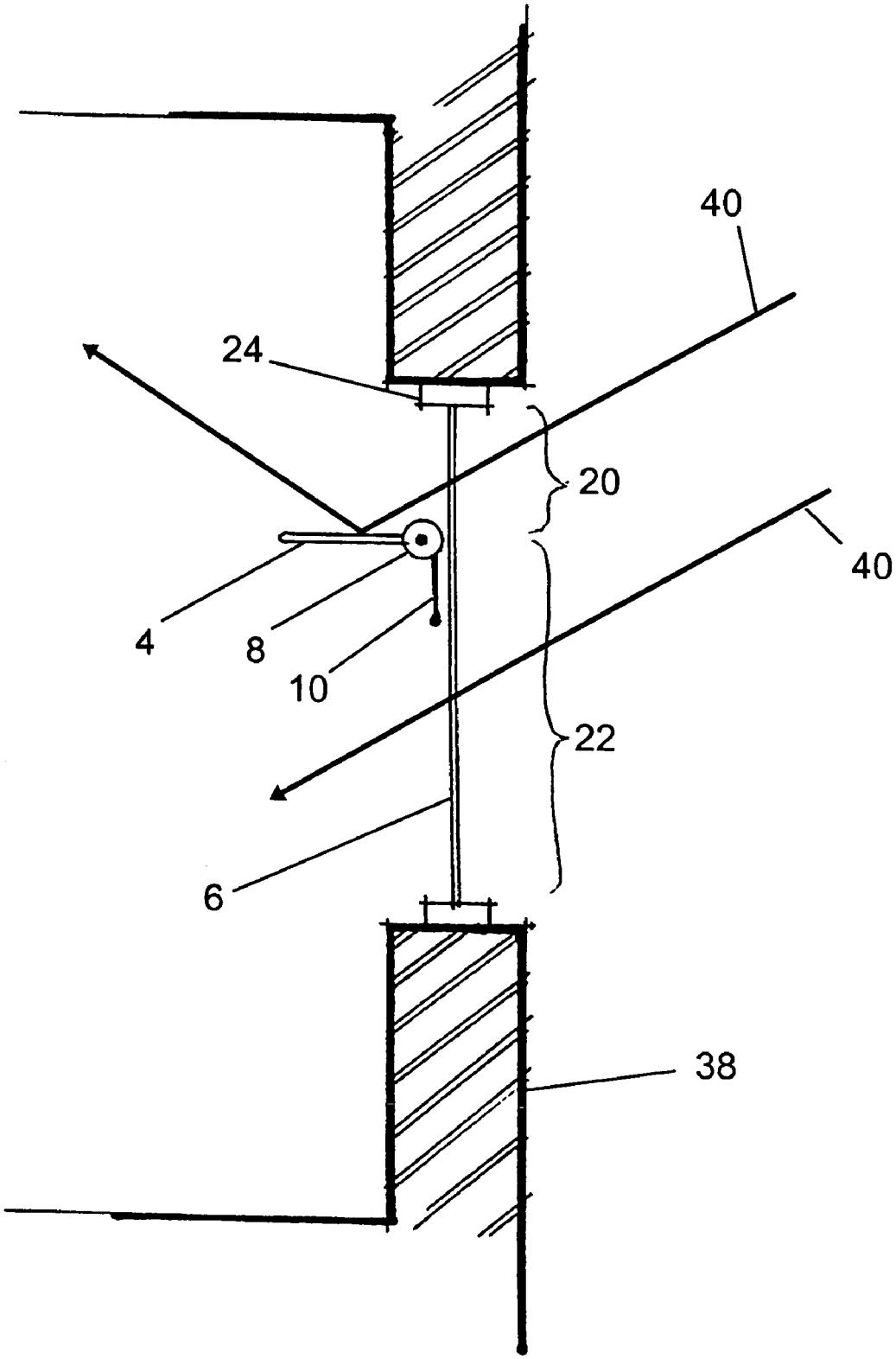
FIG. 5 is an end view of the Invention in operation with both the light shelf and blind in the open positions.

FIG. 5 illustrates the roller blind 8 and integral light shelf 4 both in the open position, allowing entry of indirect sun light 40 into a room through the upper portion 20 and direct sun light 40 through the lower portion 22 of the window 6.

Figure 6:
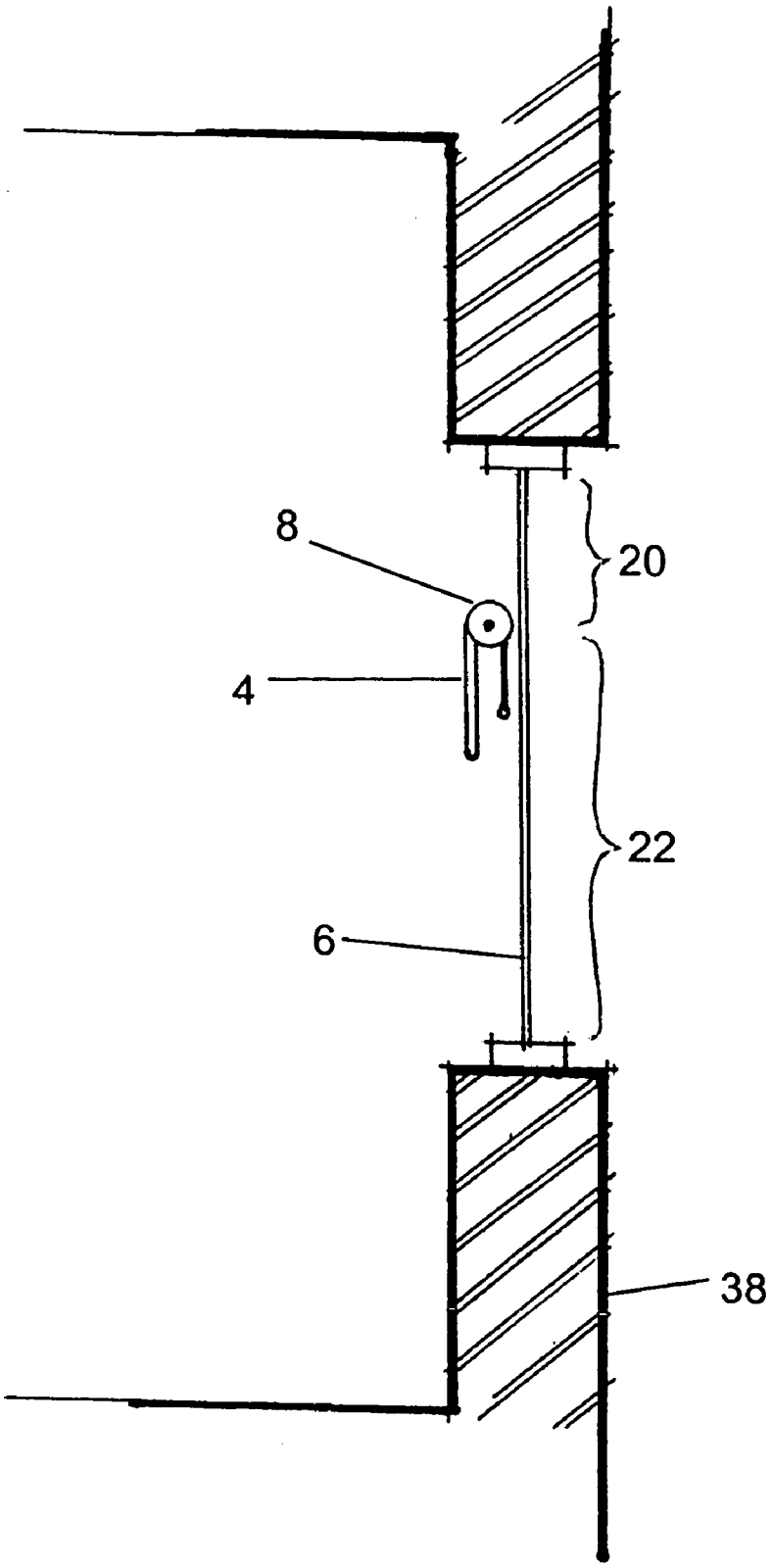
FIG. 6 is an end view of the Invention in operation with the light shelf in the damage prevention position.

FIG. 6 illustrates the light shelf 4 in a damage prevention position. If excess force is applied to the light shelf 4, the light shelf 4 could be subjected to damage. The light shelf 4 may be provided with horizontal detents 42, as shown by FIGS. 12, 13, 14, 17 and 18. An excess force applied to the top surface of the light shelf 4 causes the light shelf 4 to move past the horizontal detents 42 and to assume the damage prevention position without damage to the light shelf 4 or end support brackets 14. For a light shelf 4 controlled by a cord 32 as illustrated by FIG. 2, the cord 32 may be connected to the light shelf 4 with any suitable break-away connection 44, such as a connection using hook-and-loop fasteners. A familiar example of hook-and-loop fasteners are Velcro™ brand fasteners. For a light shelf 4 controlled by a cord 32 and equipped with a break-away connection 44, excess force applied to the light shelf 4 will cause the break-away connection 44 to separate, allowing the light shelf 4 to move to the damage prevention position and preventing harm to the light shelf 4 from the excess force.

Figure 7:
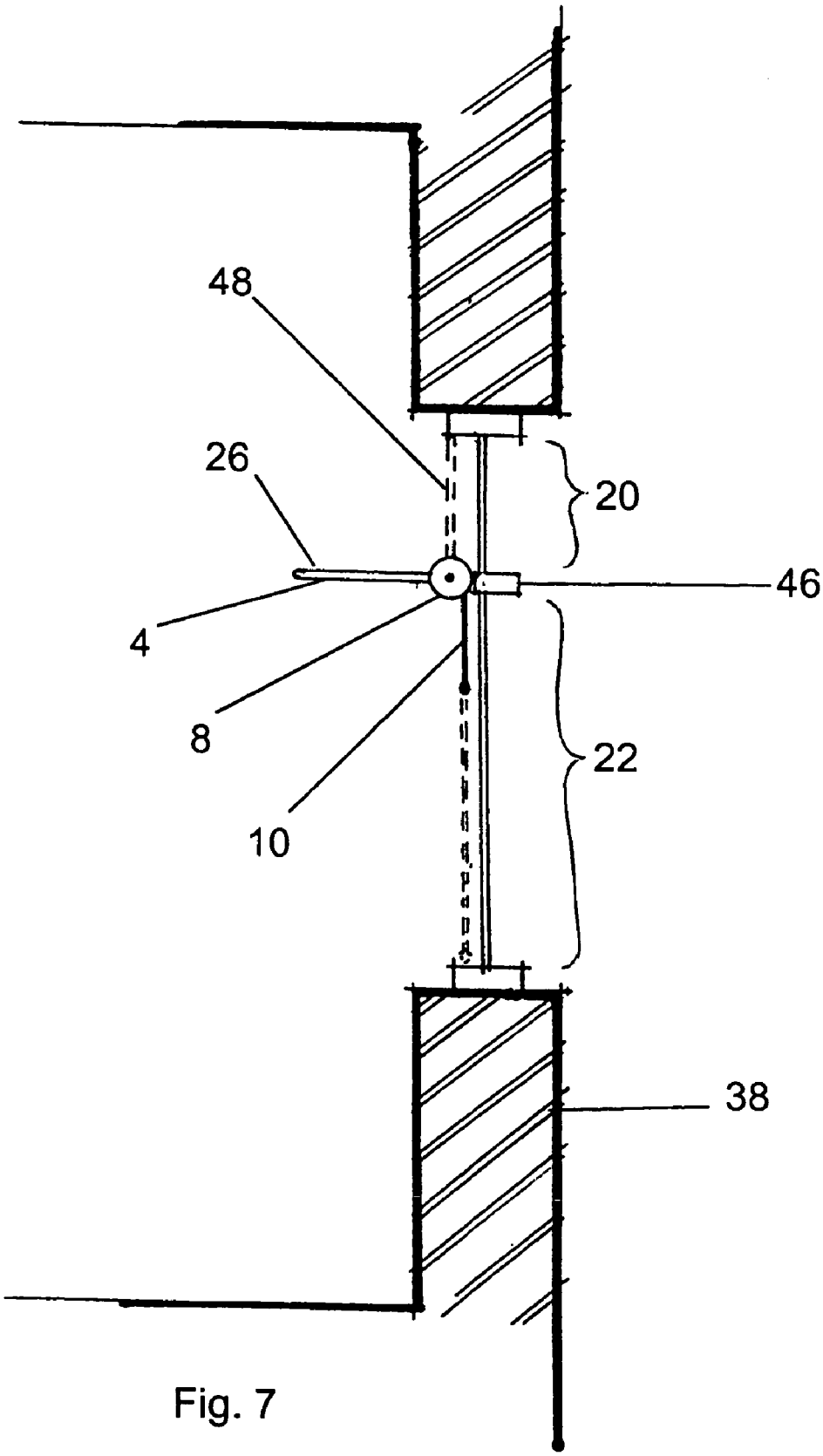
FIG. 7 is a side view of the Invention in operation.

FIG. 7 is a side view of the Invention installed in a window 6. An end support bracket 14 is attached to an architectural element, in this instance a mullion 46 dividing an upper portion 20 of a window 6 from a lower portion 22 of the window 6. The roller blind 8 is illustrated in a partially unrolled condition and the fully unrolled position is shown by dashed lines. The light shelf 4 is shown in the open position, and an alternative closed position also is illustrated by dashed lines 48.

Figure 8:
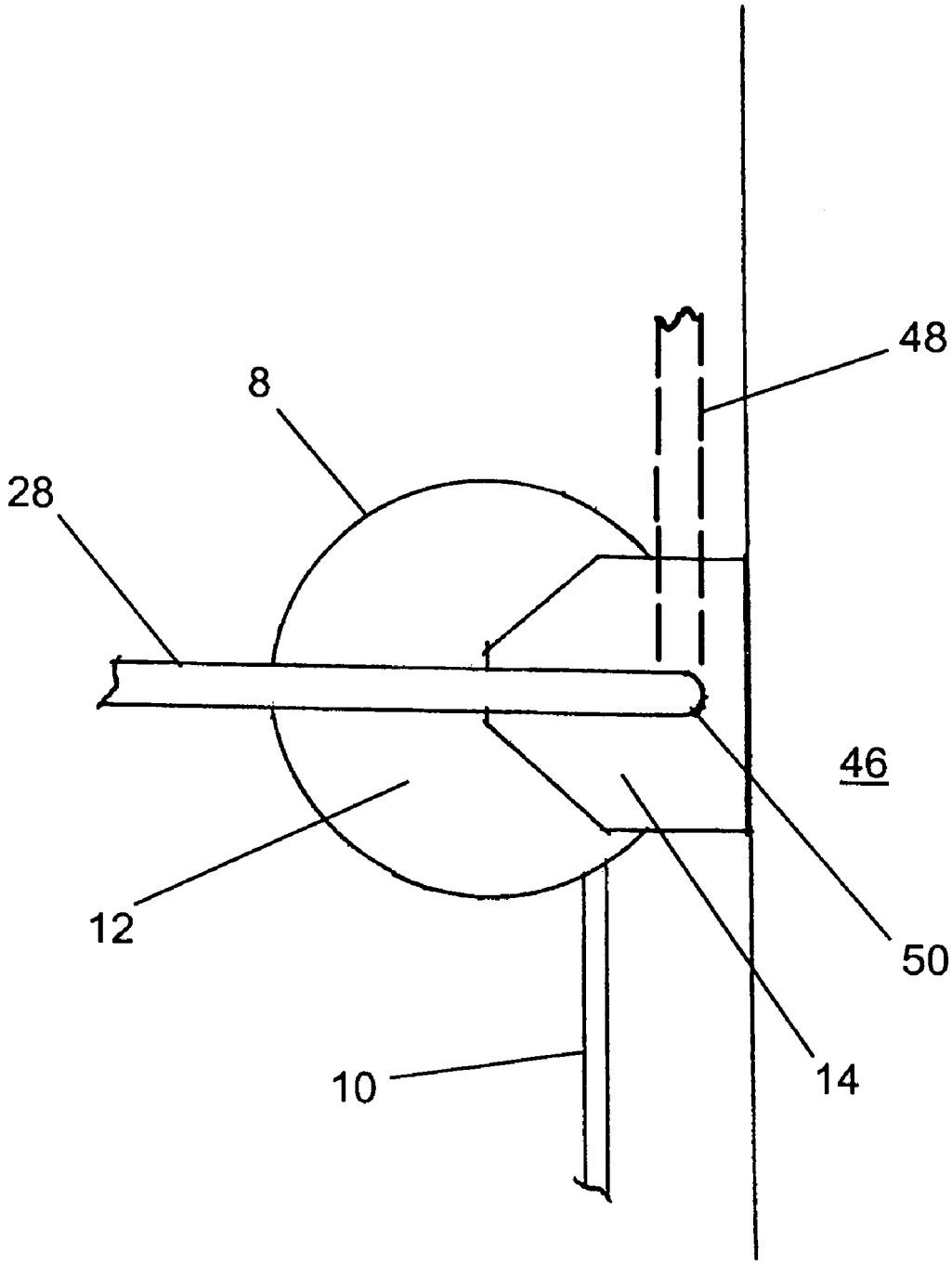
FIG. 8 is a detail side view of an alternative embodiment of the Invention.

FIG. 8 is a detail of a side view of the roller blind 8 with integral light shelf 4. An end support bracket 14 is attached to the mullion 46 of FIG. 7 and supports the roller blind 8. A light shelf bracket 50 is rotatably attached to the end support bracket 14 and may rotate from the open position, shown by solid lines, to the closed position, shown by dashed lines 48 in FIGS. 7 and 8. As noted above, FIG. 8 shows an alternative embodiment in which the center of rotation of the light shelf 4 does not coincide with the axis of rotation of the roller 12 of roller blind 8. The alternate embodiment of FIG. 8 allows the light shelf 4 to be located nearer to the window 6 when light shelf 4 is in the closed position 48, thereby blocking more light 40.

Figure 9:
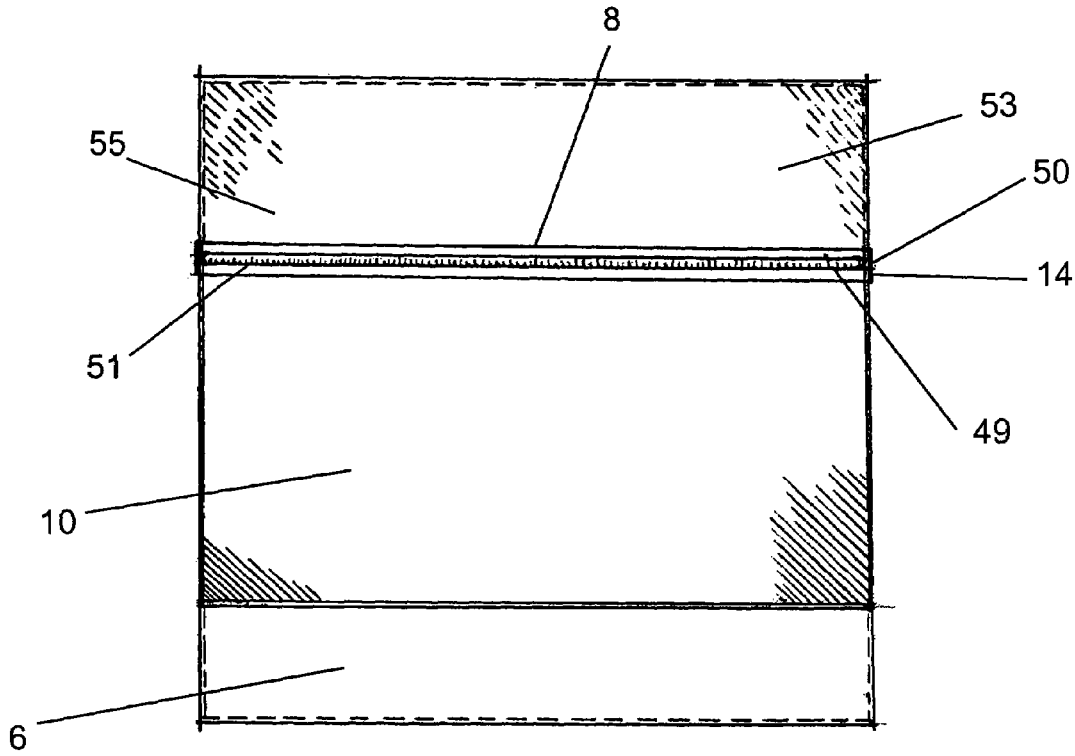
FIG. 9 is an elevation of the Invention.

FIG. 9 is an elevation of the roller blind 8 and integral light shelf 4 of FIG. 7 as seen by a person located inside the room. The roller blind 8 and light shelf 4 both are illustrated in the closed position. The roller blind 8 has a first end 49 and a second end 51, each supported by an end support bracket 14. The light shelf 4 has a first end 53 and a second end 55, each supported by a light shelf bracket 50, which light shelf brackets 50 are in turn supported by the two end support brackets 14. The end supports thereby support both the weight of the roller blind 8 and the light shelf 4.

Figure 10:
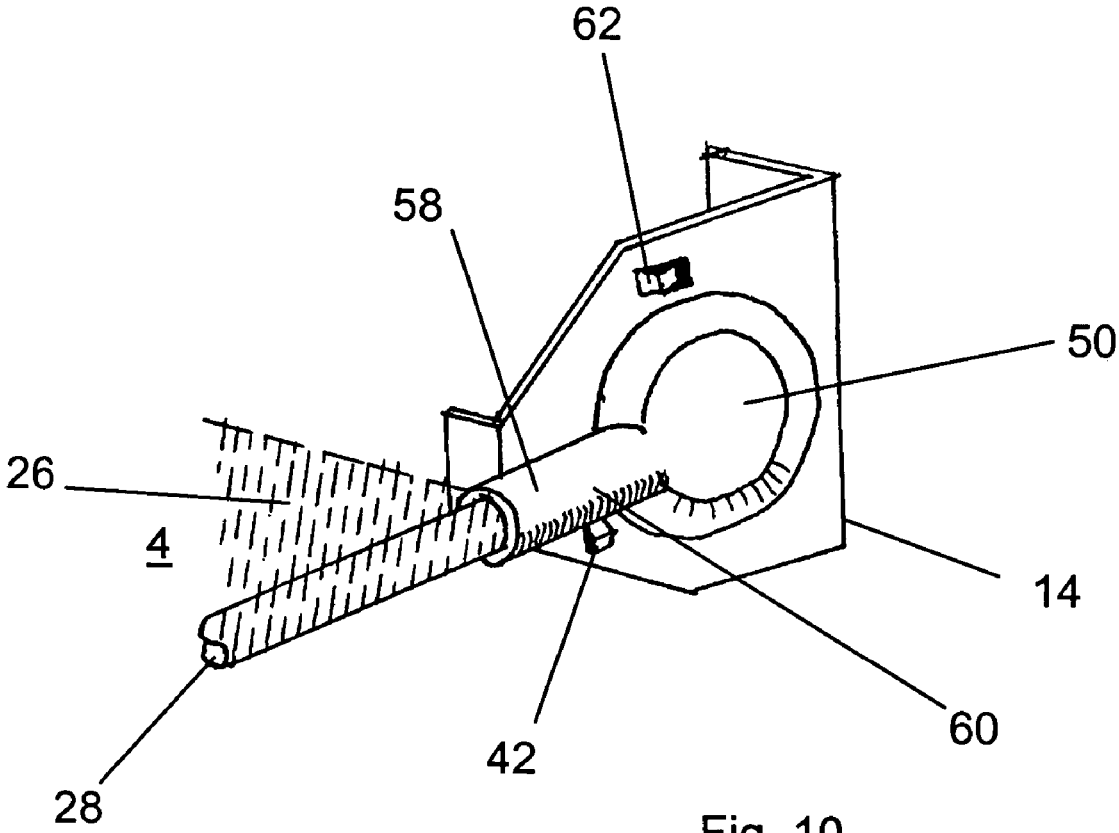
FIG. 10 is a perspective view of a detail of an end support and light shelf bracket.
Figure 11:
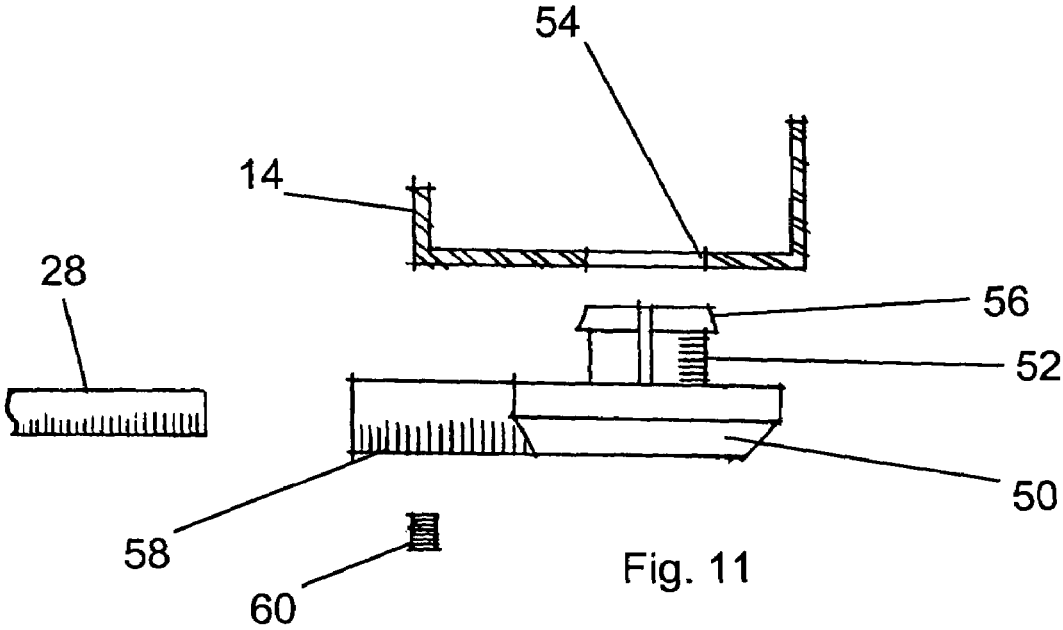
FIG. 11 is an exploded detail of a top view of the light shelf bracket and section of the end support.
Figure 12:
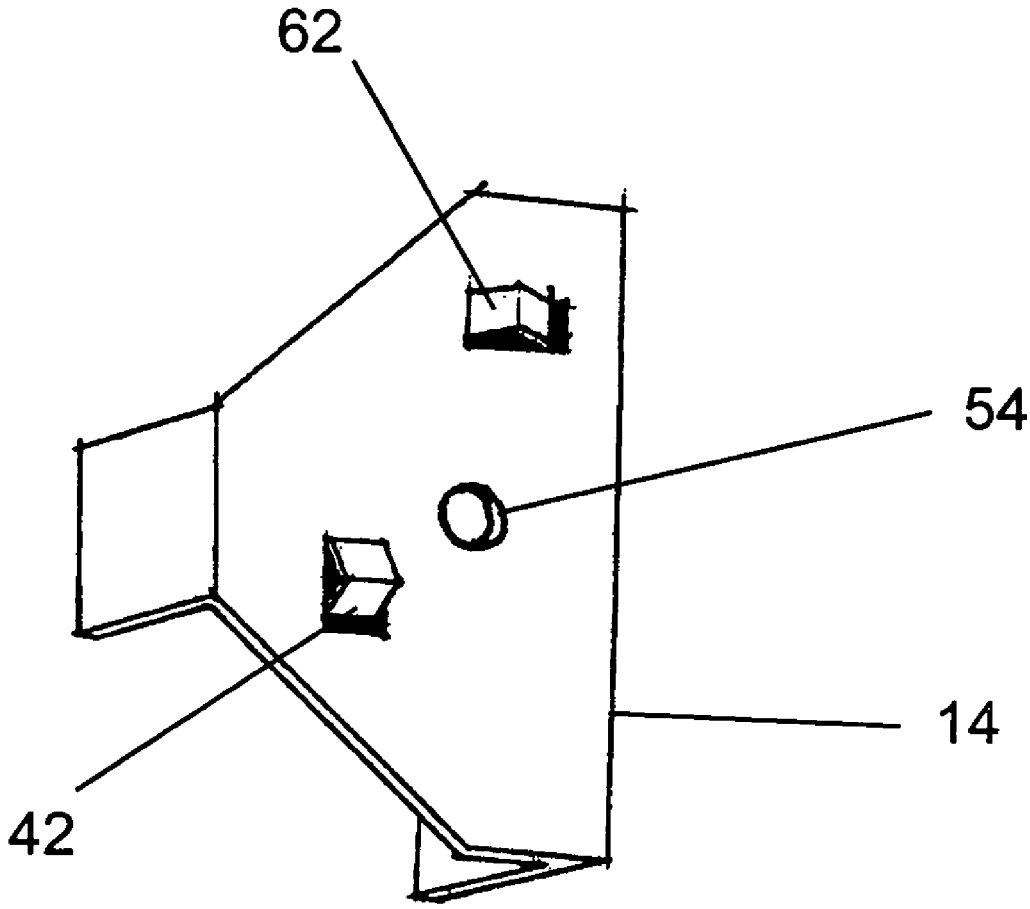
FIG. 12 is a perspective view of an end support.
Figure 13:
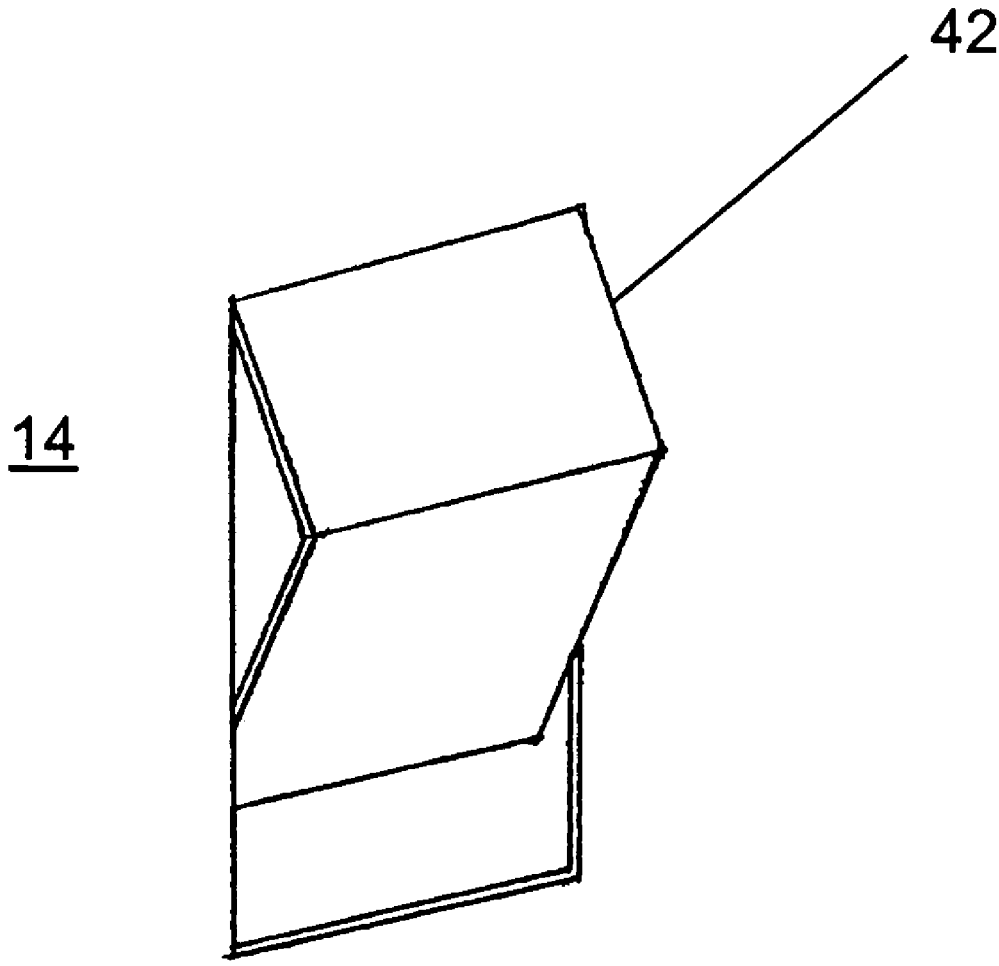
FIG. 13 is a detail perspective view of a horizontal detent.
Figure 14:
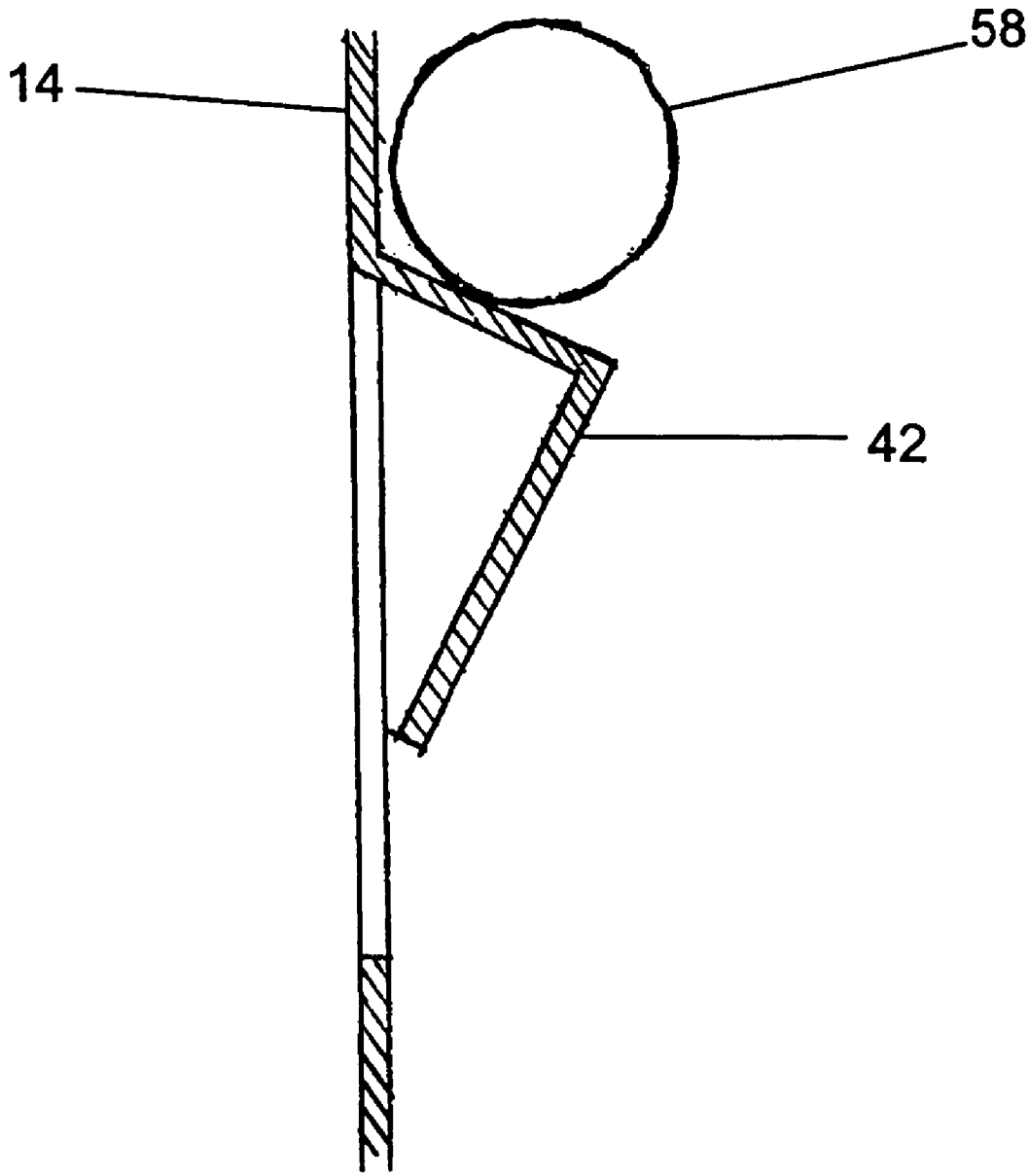
FIG. 14 is a detail sectional view of the horizontal detent.
Figure 15:
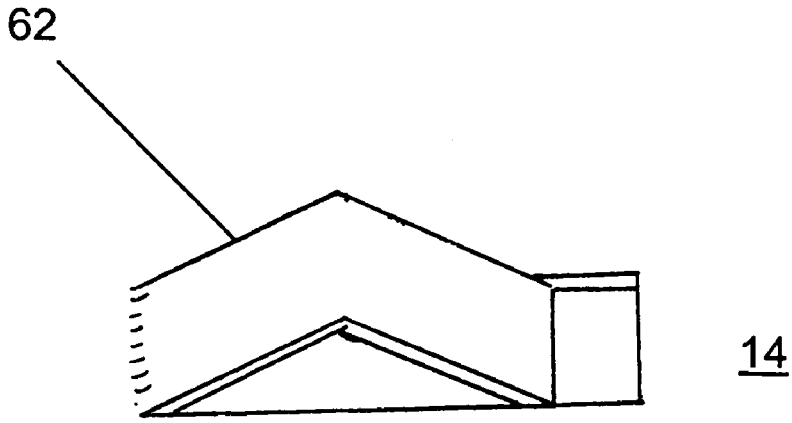
FIG. 15 is a detail perspective view of a vertical detent.
Figure 16:
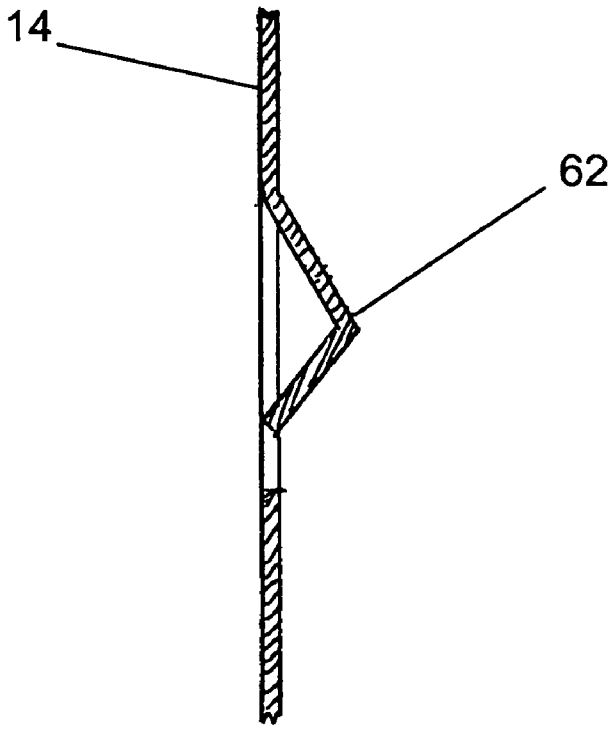
FIG. 16 is a detail sectional view of a vertical detent.
Figure 17:
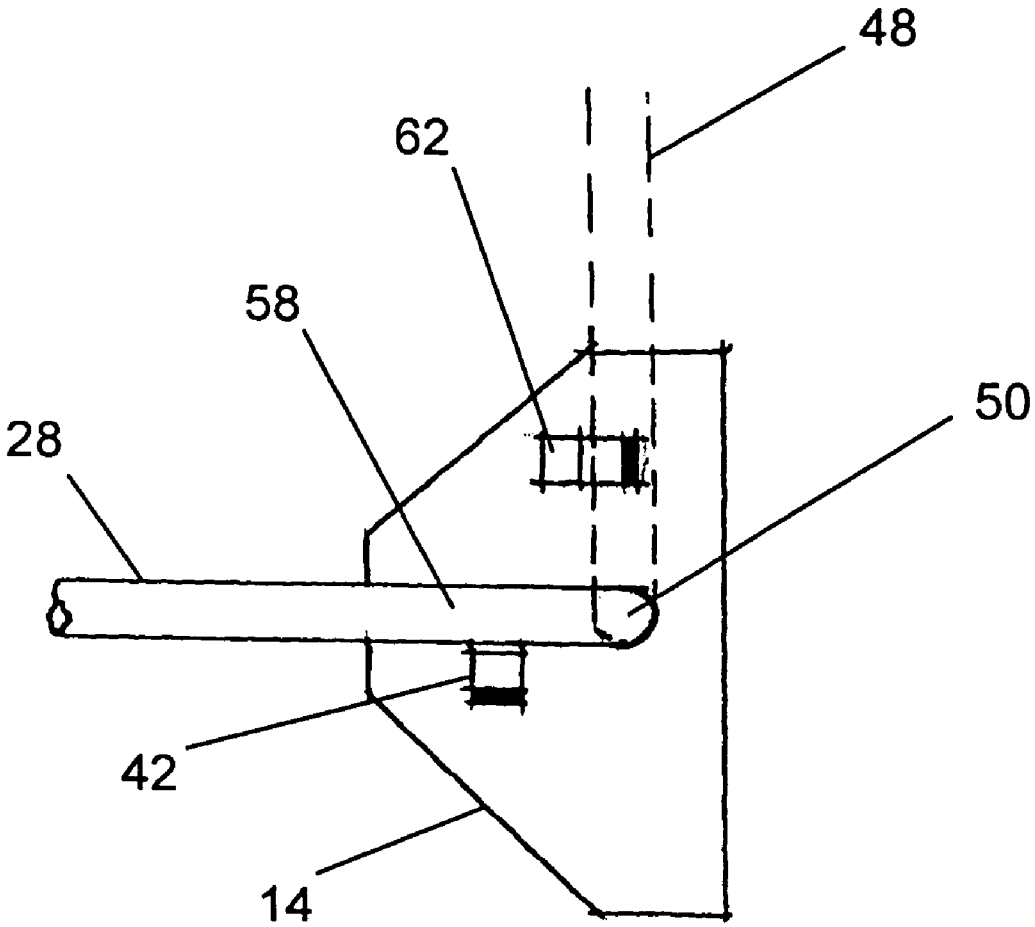
FIG. 17 is a detail side view of an end support.

FIGS. 10 and 11 illustrate one embodiment of a light shelf 4 and end support bracket 14. The end support bracket 14 supports both the roller blind 8 (not shown in FIGS. 10 and 11) and the light shelf 4. Alternatively, the end support bracket 14 may support only the light shelf 4 while the roller blind 8 is otherwise supported. A light shelf bracket 50 includes a spindle portion 52. The spindle portion 52 is generally circular in cross section and mates with a circular spindle-receiving opening 54 in the end support bracket 14. Annular ring 56 retains the spindle portion 52 in engagement with the end support bracket 14. Due to the generally circular cross section of the spindle portion 52 and the circular spindle-receiving opening 54 of the end support bracket 14, the light shelf bracket 50 may rotate while engaging the end support bracket 14. The light shelf bracket 50 also has a frame-retaining portion 58. The frame retaining portion 58 engages the frame 28 of the light shelf 4, which may be tubular, rod-shaped or any other suitable shape. A screw 60 retains the frame 28 in the light shelf bracket 50 retaining portion 58. The light shelf bracket 50 illustrated by FIGS. 10 and 11 may be composed of any suitable material, such as a polymer.

As an alternative to the cord 32 controlled light shelf 4 illustrated by FIG. 2, each of the two end support brackets 14 may be equipped with a horizontal detent 42 and a vertical detent 62, as illustrated by FIGS. 10, 12–17. The vertical and horizontal detents 42, 62 are springs formed from the material composing the end support brackets 14, as by molding (if the end support bracket 14 is formed of a molded material) or stamping (if the end support bracket 14 is composed of a sheet metal or other stamped material. To move the light shelf 4 from the open to the closed position, a user rotates the light shelf bracket 50 until the light shelf bracket 50 encounters the vertical detent 62. The user rotates the light shelf bracket 50 past the vertical detent 62, compressing the spring formed by the vertical detent 62 and moving the light shelf 4 to the closed position. The force exerted by the vertical detent 62 must be overcome to move the light shelf 4 from the vertical to the horizontal position, securing the light shelf 4 in the closed position.

The horizontal detent 42 is formed in a manner similar to the vertical detent 62 and supports the light shelf 4 in the horizontal (open) position. The horizontal detent 42 also serves to protect the light shelf 4 from excess force, as by a heavy object placed on the light shelf 4. An excessive force applied to the upper surface 26 of the light shelf 4 causes the light shelf bracket 50 to move past the horizontal detent 42 and to the damage prevention position shown by FIG. 6. Damage to the light shelf 4 from the excessive force is thereby avoided.

Figure 18:
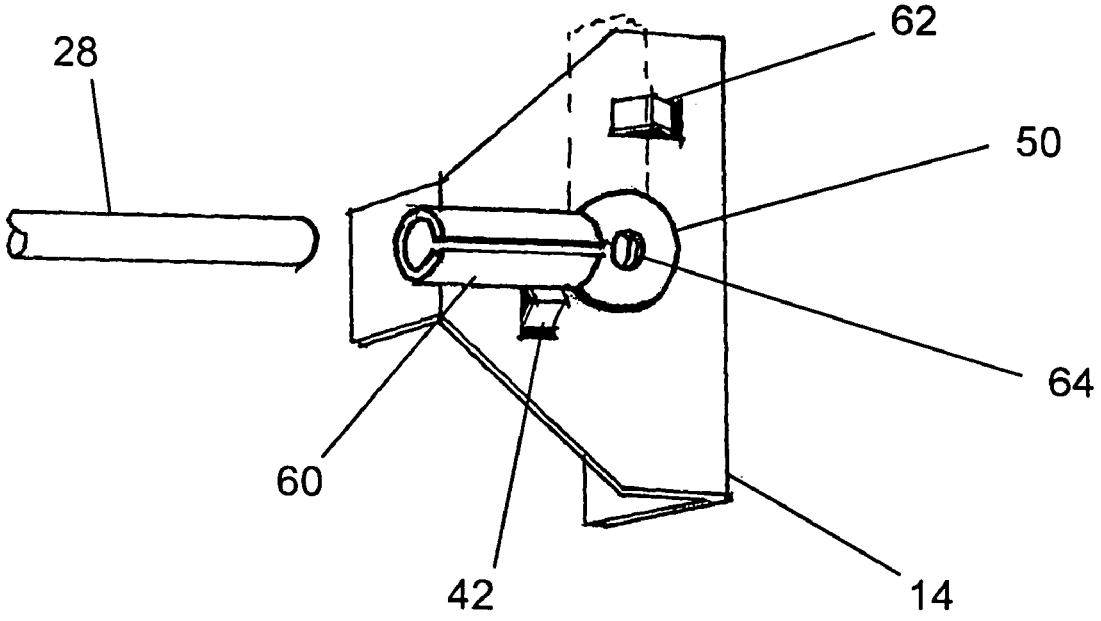
FIG. 18 is a detail perspective view of a light shelf bracket and end support.

FIG. 18 shows an alternative construction of the light shelf bracket 50. The light shelf bracket 50 of FIG. 18 is formed from a sheet material, such as sheet steel, sheet aluminum or other suitable material and is rotatably secured to the end support bracket 14 by a fastener 64, such as a bolt. The frame-retaining portion 58 of the alternate light shelf bracket 50 is rolled to receive the light shelf frame 28.

As shown by FIG. 19, a blind 2, such as a vertical blind, mini-blind, Venetian blind or roller blind may be supported by an elongated horizontal support member 66. The light shelf 4 may be rotatably mounted to the elongated horizontalsupport member 66 using light shelf brackets 50 located at the first end 49 or second end 51 of the blind 2. The horizontal support member 66 may comprise two end supports 14, as shown by FIG. 2.

A light shelf 4 may be permanently mounted in a fixed open position should selectable closure of the light shelf 4 not be required.

Rotation of the light shelf 4 may be fully manual by hand or using a suitable pole. Alternatively, the light shelf 4 may be operated using a cord 32 as illustrated in FIG. 2 or by a chain or motor drive. The operating method of the roller blind 8 may be used for operation of the light shelf 4, but is not mandatory.

In describing the above embodiments of the invention, specific terminology was selected for the sake of clarity. However, the invention is not intended to be limited to the specific terms so selected, and it is to be understood that each specific term includes all technical equivalents that operate in a similar manner to accomplish a similar purpose.

I claim:

1. An apparatus for controlling sun light entering a room through a window, the apparatus comprising:

a. a blind having a first blind end and a second blind end, said blind being adapted to define an upper portion and a lower portion of the window, said blind being adapted to selectably control sun light entering the room through said lower portion of said window;

b. a first end support bracket and a second end support bracket, said first end support bracket supporting said first blind end, said second end support bracket supporting said second blind end;

c. a light shelf, said light shelf being a planar, light-reflecting member, said light shelf having a first light shelf end and a second light shelf end, said first light shelf end being supported by said first end support bracket, said second light shelf end being supported by said second end support bracket, the window having an interior side, said first and said second end support brackets being adapted to support said blind and said light shelf on said interior side of the window, said light shelf having a closed position and an open position, said closed position and said open position being user selectable, said light shelf being adapted to substantially shade the room from sun light from said upper portion of the window when said light shelf is in said closed position and to substantially reflect into the room sun light entering the room from said upper portion of the window when said light shelf is in said open position, said light shelf being rotatably attached to said first and said second end support brackets, said light shelf defining a plane, said plane being generally perpendicular to the window when said light shelf is supported on said inside of the window and said light shelf is in said open position, said plane being generally parallel to the window when said light shelf is supported on said inside of the window and said light shelf is in said closed position.

2. The apparatus of claim 1, said light shelf further comprising:

a. a light shelf frame, said rotatable attachment of said light shelf to said first and said second end support brackets comprising said light shelf frame being rotatably attached to said first and said second end support brackets;

b. a light shelf web supported by said light shelf frame.

3. The apparatus of claim 2, said rotatable attachment of said light shelf frame to said first and said second end support brackets comprising: said light shelf frame having a first and a second spindle portion, said first and said second end support brackets each defining a spindle-receiving opening, said first spindle portion engaging said spindle-receiving opening of said first end support bracket, said second spindle portion engaging said spindle-receiving opening of said second end support bracket.

4. The apparatus of claim 3 wherein said light shelf further having a damage prevention position, said light shelf adapted to move from said open position to said damage prevention position in response to an excess force applied to said light shelf, thereby preventing damage to said light shelf.

5. The apparatus of claim 4 wherein said first end support bracket and said second end support bracket each having a horizontal detent adapted to releasably hold said light shelf in said open position, said first and said second end support brackets each having a vertical detent adapted to releasably hold said light shelf in said closed position.

6. An apparatus for controlling the entry of light into a room through a window, the apparatus comprising:

a. a roller blind having a first end and a second end, said roller blind being adapted to divide the window into an upper portion and a lower portion, said roller blind being adapted to selectably control sunlight entering the window through said lower portion of the window;

b. a first end support bracket rotatably supporting said first end of said roller blind;

c. a second end support bracket rotatably supporting said second end of said roller blind;

d. a light shelf, said light shelf being a planar, light-reflecting member, said light shelf being adapted to selectably control the entry of sunlight into the room through said upper portion of the window, said light shelf having a first light shelf end and a second light shelf end, said first light shelf end being supported by said first end support bracket, said second light shelf end being supported by said second end support bracket, the window having an interior side, said first end support bracket and said second end support bracket being adapted to support said first end and said second end of said roller blind and said first end and said second end of said light shelf on said interior side of the window.

7. The apparatus of claim 6 wherein said light shelf having a first position, said light shelf when supported on said interior side of the window and in said first position being substantially perpendicular to the window, said light shelf having a second position, said light shelf when supported on said interior side of the window and in said second position being substantially parallel to the window.

8. The apparatus of claim 7, said light shelf comprising:

a. a light shelf frame, said support of said first and said second light shelf end by said first and said second end support brackets comprising said light shelf frame rotatably engaging said first and said second end support brackets;

b. a light shelf web supported by said light shelf frame.

9. The apparatus of claim 8 wherein said light shelf having a damage prevention position, said light shelf rotating about said rotatable engagement between said light shelf frame and said first and said second end support brackets to said damage prevention position in response to an excessive force applied to said light shelf.

10. An apparatus for controlling the entry of light into a room through a window, the apparatus comprising:

a. a roller blind having a first end and a second end;

b. a first end support bracket supporting said first end of said roller blind;

c. a second end support bracket supporting said second end of said roller blind;

d. a light shelf, said light shelf being a planar, light-reflecting member, said light shelf having a first light shelf end and a second light shelf end, said first light shelf end being supported by said first end support bracket, said second light shelf end being supported by said second end support bracket, the window having an interior side, said first end support bracket and said second end support bracket being adapted to support said first end and said second end of said roller blind and said first end and said second end of said light shelf on said interior side of the window, said light shelf having a first position, said light shelf when supported on said interior side of the window and in said first position being in a first user-selectable relationship with the window, said light shelf having a second position, said light shelf when supported on said interior surface of the window and in said second position being in a second user-selectable relationship with the window;

e. a light shelf frame, said support of said first and said second light shelf end by said first and said second end support brackets comprising said light shelf frame rotatably engaging said first and said second end support brackets;

f. a light shelf web supported by said light shelf frame;

g. said light shelf having a damage prevention position, said light shelf moving to said damage prevention position in response to an excessive force applied to said light shelf;

h. said first end support bracket and said second end support bracket each defining a first detent releasably holding said light shelf in said first position and a second detent releasably holding said light shelf in said second position, said excessive force applied to said light shelf overcoming said first detent and moving said light shelf from said first position to said damage prevention position.

11. An apparatus for controlling sun light entering a room through a window, the apparatus comprising:

a. a support member;

b. a blind supported by said support member;

c. a light shelf, said being a planar, light-reflecting member, said light shelf being supported by said support member, said light shelf having an upper surface, said light shelf having an open position and a closed position, the window having an interior side, said support member being adapted to support said blind and said light shelf substantially adiacent to said interior side of said window;

d. said light shelf being adapted so that when said light shelf is supported on said interior side of the window and in said open position sun light passing through the window and reflecting from said upper surface is reflected generally toward a ceiling of said room, said light shelf further adapted so that when said light shelf is supported on said interior surface of the window and in said closed position said sun light passing through said window and reflected from said upper surface generally is reflected away from said room;

e. a light shelf frame, said adaptation of said support member to support said light shelf comprising said light shelf frame being rotatably attached to said support member;

g. a light shelf web, said light shelf web being supported by said light shelf frame;

h. said light shelf web consisting of a material selected from the list of a synthetic fabric, a natural fabric, a paper, a foam, a polymer, a sheet of metal and a piece of wood;

i. said support member comprising a first end support bracket and a second end support bracket and wherein said blind being a roller blind having a first end and a second end, said first end of said roller blind being supported by said first end support bracket, said second end of said roller blind being supported by said second end support bracket.

* * * * *